10/22/85 OF 4,548,683

United States Patent [19]

Huang et al.

[11] Patent Number: 4,548,683

[45] Date of Patent: Oct. 22, 1985

[54] METHOD OF ELECTROLYTICALLY GRAINING A LITHOGRAPHIC PLATE

[75] Inventors: Jen-chi Huang, Ossining; Gregory Von Gruenberg, Mohegan Lake, both of N.Y.; Donald J. Riley, Tenafly, N.J.

[73] Assignee: Polychrome Corp., Yonkers, N.Y.

[21] Appl. No.: 655,659

[22] Filed: Sep. 28, 1984

[51] Int. Cl.[4] ..... C25F 3/04

[52] U.S. Cl. ..... 204/129.4; 204/129.75; 204/DIG. 9

[58] Field of Search ..... 204/129.4, 129.43, DIG. 9, 204/129.75

[56] References Cited

U.S. PATENT DOCUMENTS

| | | | |
|---|---|---|---|
| 4,140,599 | 2/1979 | Yamasaki et al. | 204/129.43 |
| 4,294,672 | 10/1981 | Ohba et al. | 204/129.4 |
| 4,297,184 | 10/1981 | Dyer | 204/DIG. 9 |
| 4,396,468 | 8/1983 | Walls | 204/129.4 X |
| 4,455,200 | 6/1984 | Okamoto | 204/129.4 X |
| 4,468,295 | 8/1984 | Pliefke | 204/129.4 X |

*Primary Examiner*—Donald R. Valentine

[57] ABSTRACT

A method is provided for electrolytically graining an aluminum lithographic plate to produce a grained surface with a honeycomb topography, non-directional grain structure, and a substantially reduced production of smut. The reduction of smut is achieved by utilizing an alternating current of higher frequencies, generally in the range of approximately 140 to 400 Hz.

7 Claims, No Drawings

METHOD OF ELECTROLYTICALLY GRAINING A LITHOGRAPHIC PLATE

FIELD OF THE INVENTION

This invention relates to an electrolytic graining process for lithographic plates, and more particularly to a method of electrolytically graining a lithographic substrate which will be characterized by a substantial reduction in smut formation.

BACKGROUND OF THE INVENTION

In the electrolytic process of graining a lithographic plate, it has been observed that a layer of heavy, dark smut is usually deposited upon the surface of the plate after subjecting the plate to an alternating current at a current density below 15 amps per square decimeter ($A/dm^2$) and at a concentration greater than 10 grams per liter of acid, especially hydrochloric acid. It is generally believed that smutting is caused by the increased surface area produced by the graining process. It would be desirable to eliminate or reduce the smut build-up. Reducing or eliminating the smut would make the electrolytic process more cost-effective by eliminating the additional steps presently required to clean the grained surface.

In order to achieve a desirable grain topography in aluminum plate an improved electrochemical surface process has been developed wherein the alternating current wave form is varied to provide a greater anodic phase. Also, such wave shaping has provided a pause in the current between anodic and cathodic phases. The above process is described in the U.S. Pat. No. 4,294,672, issued Oct. 13, 1981 to Ohba et al.

The improved graining process utilizes an alternating current of standard frequency of 50 to 60 Hz. Some mention is made that higher frequencies have been observed to provide pits of smaller size in the aluminum surface. However, the use of higher frequencies has not been suggested as a means of eliminating or reducing smut, and there is no disclosure of at what current density pit formation occurs. In fact the increase in the surface area achieved by the production of the small grain size would lead those skilled in this art to expect a heavier and darker smut layer to be formed. In the improved process as disclosed in the prior art, the electrolytically grained plates are routinely desmutted with nitric acid, sodium bisulfate, or alkaline solution.

In U.S. Pat. No. 4,297,184 issued Oct. 27, 1981 to Dyer, mention is made of a process using lowered alternating current frequencies of 15 and 25 Hz. Wave shaping is also employed to provide etched aluminum foil of greater capacitance. There is, however, nothing whatsoever in this patent about the effect of the lowered frequency upon the formation of smut. U.S. Pat. No. 4,376,686 issued Mar. 15, 1983 to Arora, mentions low AC frequency of 12 to 20 Hz for aluminum foil of higher capacitance, nothing is said about smut formation.

SUMMARY OF THE INVENTION

The present invention comprises a method of producing a substantially non-directional, honeycomb topography in a lithographic plate, with the grained surface.

It has been observed, that an aluminum plate immersed in an acidic bath at 30° C. comprising hydrochloric acid and subjected to an alternating current of lower or standard frequency, will produce a heavy, dark smut on the grained aluminum metal surface.

The present invention employs an alternating current with a current density in a range of approximately 7 to 22 $A/dm^2$, and in an approximate frequency range of 140 to 400 Hz. The grained surface had a white appearance and needed little or no desmutting.

DETAILED DESCRIPTION OF THE INVENTION

An AA 1050 aluminum plate is immersed in an electrolytic bath containing 1% HCl+1 g/l Al. The bath temperature was 130° C. The aluminum plate was electrolytically grained by subjecting the plate to an alternating current having a current density of 12.4 $A/dm^2$ for 60 seconds. The etched surface was observed carefully for the formation of smut, with the use of different alternating current frequencies of 30–650 Hz. These observations were made by visual inspection and scanning electron microscope (SEM). The results of the experimental examples are listed in Table 1 below:

| Example | A.C. Freqency | Observations |
|---|---|---|
| 1 | 30–60 Hz | Black smut, directional honeycomb |
| 2 | 70–130 Hz | Grey pit and plateau |
| 3 | 140–600 Hz | Light grey smut, honeycomb with non-directional grains. |

It will be observed from the foregoing table that the use of higher alternating current frequencies will produce a grained aluminum surface having a non-directional grain with a substantial reduction in the formation of smut. When smut formation is essentially avoided or substantially reduced the conventional smut removal step employed following electrochemical graining treatment can be eliminated. In other words, the resulting aluminum plate can either be directly coated with a photosensitive material or subjected to one or more non-smut removal, anodizing, and interlaying treatments prior to being coated with the photosensitive material.

As disclosed in column 2, lines 21 to 55, of U.S. Pat. No. 4,294,672; conventional acidic formations can be employed as the electrolytic bath solution. The especially preferred aqueous baths contain hydrochloric or nitric acid or mixtures thereof as the electrolyte. The concentration of such electrolytes may vary from about 0.5 to 5% by weight. These and other features of the electrolytic baths disclosed in line 21 to 55 are incorporated herein by reference. This incorporation by reference includes the disclosures in columns 5 and 6 of U.S. Pat. No. 4,294,672 which encompass pretreatment of the aluminum plate before being subjected to the electrochemical graining; treatments intermediate electrochemical graining and coating with a photosensitive material, e.g. anodizing and interlayering with an alkali metal silicate and/or carboxymethyl cellulose; and the coating treatment with a photosensitive material such as the diazo-containing formulations such as disclosed in U.S. Pat. No. 3,860,426; U.K. published patent application 2,030,309A; and the photosensitive materials disclosed in columns 6 and 7 of U.S. Pat. No. 4,294,672.

While the above examples give a typical procedure for carrying out the method of this invention it will be understood that the invention is subject to variations and modifications without departing from the broader scope.

What is claimed is:

1. In a method of electrolytically graining a surface of a lithographic plate comprising immersing said lithographic plate in an acidic bath; and subjecting said lithographic plate to an alternating current for a time period sufficient to attain said graining; the improvement which comprises utilizing an alternating current having a current density within the range of about 7 to 22 $A/dm^2$, and a frequency of 140 to 400 Hz to obtain a lithographic plate surface characterized by a substantially non-directional honeycomb typography together with a substantial reduction in smut formation.

2. In the method of claim 1 wherein the current density of the alternating current ranges from about 10 to 18 $A/dm^2$.

3. In the method of claim 1 wherein the frequency of the alternating current is from about 160 to 300 Hz.

4. In the method of claim 1 wherein said lithographic plate comprises aluminum metal.

5. In the method of claim 1 wherein said acid bath comprises hydrochloric acid, nitric acid, or mixtures thereof.

6. In the method of claim 1 wherein said current is applied to said plate for about 5 to 300 seconds.

7. In the method of claim 1 wherein said acid bath has a temperature in the range of from 20° to 50° C.

* * * * *